US005948351A

United States Patent [19]

Reiter

[11] Patent Number: 5,948,351

[45] Date of Patent: Sep. 7, 1999

[54] OUTLET DEVICE FOR A MELTING CRUCIBLE

[75] Inventor: Christian Reiter, Derendingen, Switzerland

[73] Assignee: Shouzui Yasui, Tokyo, Japan

[21] Appl. No.: 08/986,813

[22] Filed: Dec. 8, 1997

[30] Foreign Application Priority Data

Dec. 27, 1996 [CH] Switzerland ..... 3188/96

[51] Int. Cl.[6] ..... C21C 5/42

[52] U.S. Cl. ..... 266/236; 266/275; 222/602

[58] Field of Search ..... 222/602, 594; 266/236, 275; 432/263, 262

[56] References Cited

U.S. PATENT DOCUMENTS

| | | | |
|---|---|---|---|
| 1,832,873 | 11/1931 | Milner | 266/236 |
| 3,415,427 | 12/1968 | Sharp | 222/602 |
| 3,762,605 | 10/1973 | Seaton | 222/602 |

*Primary Examiner*—Scott Kastler
*Attorney, Agent, or Firm*—Notaro & Michalos P.C.

[57] ABSTRACT

A melting crucible (1) comprises a collecting volume (6) for liquid material and is equipped with a bottom outlet opening (2). This bottom outlet opening (2) is closable with a movable stopper (3). The bottom outlet opening (2) comprises a specially formed transition region (7), and the front end of stopper (3) is also specially formed. This shaping leads to improved flow conditions and to optimum sealing between stopper (3) and melting crucible (1).

6 Claims, 1 Drawing Sheet

OUTLET DEVICE FOR A MELTING CRUCIBLE

FIELD AND BACKGROUND OF THE INVENTION

The invention relates to an outlet device for a melting crucible for a vacuum casting installation for small parts comprising a melting crucible with a bottom outlet opening in the form of a cylindrical bore and a stopper for closing the bottom outlet opening.

Vacuum casting installations for small parts are known in which in particular precious metals and light metals are cast. In these known installations a collecting volume for molten material is disposed above the mold and this collecting volume can be part of the melting crucible or can be fed via an inflow channel. In the case of the implementations in which the collecting volume is a part of the melting crucible, the melting crucible is often equipped with an induction heater. On the bottom surface of the melting crucible a bottom outlet opening is disposed which is closable with a stopper. The stopper is therein guided through the collecting volume for the molten material in the melting crucible and is movable in the direction of the longitudinal axis of the melting crucible. When casting precious metals, only that quantity of raw material is charged into the melting crucible which is necessary for filling a casting mold. The material is melted in the melting crucible with the stopper closed and, when the desired casting temperature is reached, is poured off by opening the stopper. The known combinations of stopper and bottom outlet openings forming the outlet device are therein implemented such that they ensure good sealing during the melting process. For this purpose the front end of the stopper is implemented semispherically or conically. The beginning of the bottom outlet opening directed toward the collecting volume for the molten material is either sharp-edged or provided with an oblique conical surface.

With this implementation of the bottom outlet opening and of the front end of the stopper difficulties are encountered in practice since, after the opening of the stopper, the liquid jet of material flowing out becomes detached at the inlet edges of the bottom outlet opening and generates eddies, jet pinching and flow separation. As a consequence the outflow rate and the outflow quantity are reduced and the time for the flowing-out of the required quantity of material into the casting mold is thereby prolonged. In addition, the danger exists that through the turbulences gas is entrained and included in the liquid material and material particles from the walls of the bottom outlet opening are entrained and impurities form. Due to the extension of the casting time, the solidification process is not uniform in all regions of the casting mold and different crystallization structures and thus faults in the poured-off object can form. In addition, the disadvantage exists that through the turbulences and detachments metal particles, solidified at the end of the casting process, accumulate in the wall regions which hinder the subsequent casting process or disturb the sealing between stopper and bottom outlet opening. This results in the necessity of having to move the stopper out of the melting crucible after every casting process and checking and cleaning the bottom region of the collecting volume for the molten material and the outlet opening in order to be able to carry out the subsequent casting process without disturbances. This necessitates additional operating expenditures and loss of time which reduces the economy of such installations.

SUMMARY OF THE INVENTION

It is the task of the present invention to create an outlet arrangement for melting crucibles in which the liquid material can flow into and through the bottom outlet opening without forming turbulences and in which the jet of liquid fills the entire cross section of the outlet opening and flows through it at maximum rate. Furthermore, it is intended to prevent that in the region of the bottom outlet opening and at the front end of the stopper material residues accumulate and a maximum sealing effect is to be attained when the stopper is closed.

This task is solved according to the invention through the characteristics cited in the claims. Through the combination of the cylindrical bore at the bottom outlet opening with a transition region which expands toward the collecting volume for the molten material in the melting crucible with a curved wall surface the advantage results that a laminar flow forms in the liquid and that the flow does not become detached from the walls at any site of the inflow region. Therewith turbulences are prevented and no flow losses occur. This optimization of the flow is further additionally supported thereby that the front end of the stopper is formed of a conical tip and an adjoining curved sealing region. Consequently, around the front end of the stopper also optimum flow conditions develop and, with the stopper completely open, it is ensured that the material flow at the side directed toward the external surfaces as well as also on the inside directed toward the stopper flows completely uniformly and without turbulences. The material flow in the bottom outlet opening always fills the entire cross section and the best possible outflow rates are always attained. This leads to considerably shorter pouring-off times for a specific quantity of material or greater quantities of material can be poured off in the same time.

Especially advantageous is the application of the outlet device in small casting machines for precious metals, in particular corresponding vacuum casting installations. In the case of such casting installations the melting crucible can have for example a volume of approximately 5 $cm^3$ to, for example, 2000 $cm^3$. The curved wall surface in the transition region of the outlet opening in this case has a radius of curvature of at least 2 mm and at the maximum a radius which is greater by a factor of twelve than the radius of the bore of the cylindrical portion of the outlet opening. An additional advantage is obtained if the bottom surface of the collection volume for the closed material in the melting crucible increases from the outlet opening toward the outer jacket and the curved transition region changes continuously into this oblique surface. This oblique bottom surface usefully forms an angle of at least 5° relative to a horizontal surface. A further advantage results if the length of the cylindrical region of the outlet opening is at least twice as long as the diameter of this cylindrical portion. The advantages of the stopper implemented according to the invention are attained if the conical tip of the stopper forms an angle of at least 50° to maximally 140° and the curved sealing surface adjoining the conical tip has a radius of at least 2 mm and maximally a radius greater by the factor twelve than the bore of the cylindrical portion of the outlet opening. Apart from optimum flow conditions, this embodiment ensures also minimum abrasion of the front end of the stopper and at the sealing surface of the outlet opening through the flowing material. In addition, through the shaping according to the invention of the bottom outlet opening and of the front end of the stopper greater security with respect to sealing is also attained since, with the stopper closed, a linear sealing region is formed and a sufficiently high surface pressing is already generated in the closure region at relatively low closing forces of the stopper. The stopper also adapts better to potential geometric axial deviations and it cannot become wedged in the bottom outlet opening. Thereby the operational security and the service life of the outlet device are increased.

DESCRIPTION OF THE PREFERRED EMBODIMENT

Figure 1:
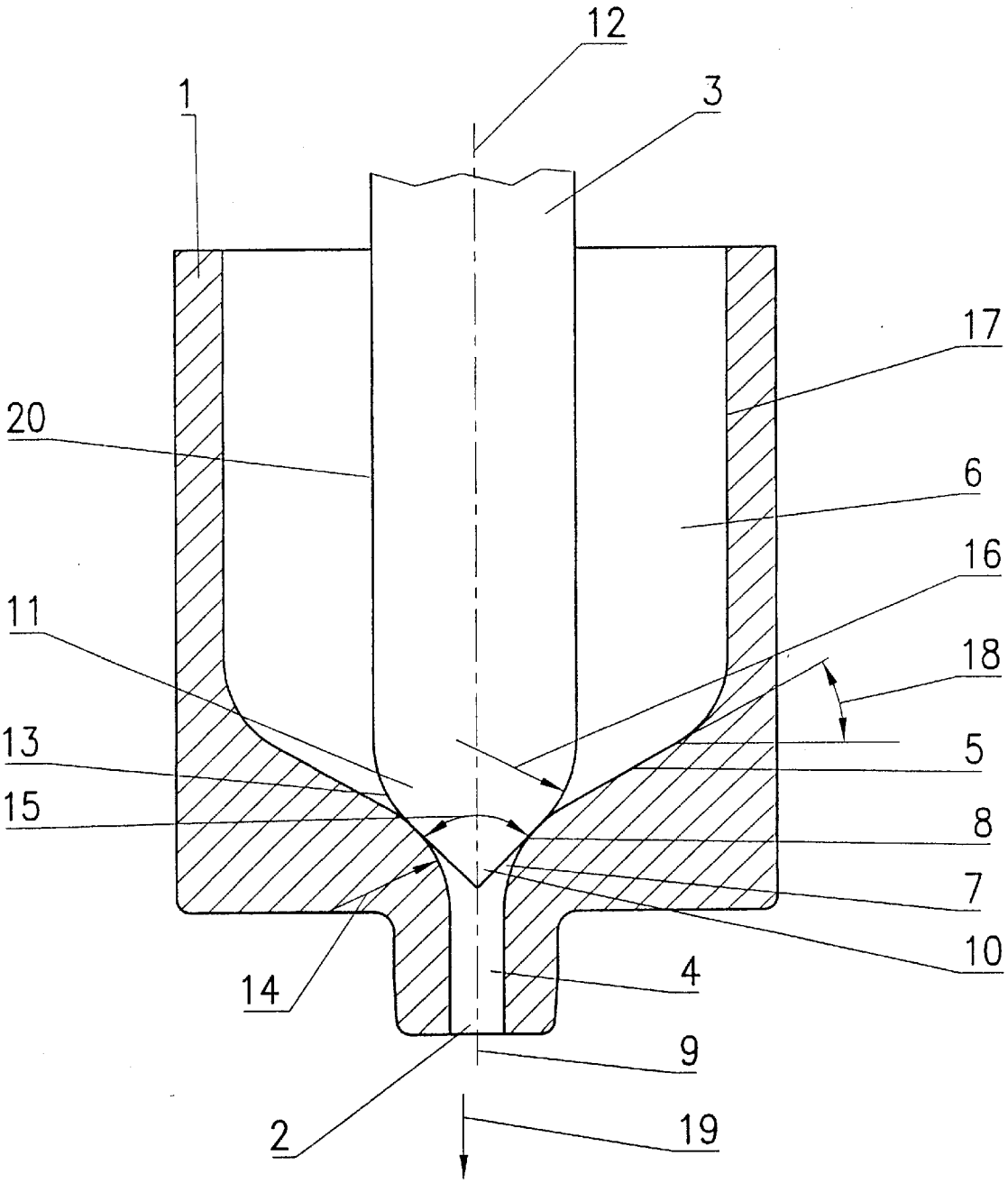
FIG. 1 is a sectional view of a melting crucible according to the present invention.

In the following the invention will be explained in further detail in conjunction with an embodiment example with reference to the enclosed drawing. FIG. 1 shows a segment of a melting crucible 1 and specifically the bottom region with a bottom outlet opening 2 and the lower free end of the stopper 3. In the melting crucible 1 is present a hollow volume which forms a collecting volume 6 for molten material. Such melting crucibles 1 are in particular used for casting precious metals and light metals, for example gold, silver, platinum, aluminum etc. In the example shown the collecting volume 6 serves simultaneously as the melting volume and the melting crucible 1 is encompassed by an induction coil (not shown). With the aid of this induction coil raw material placed into the collecting volume 6 is heated and melted and brought to the necessary casting temperature. During the melting process the bottom outlet opening 2 is closed by means of the stopper 3. Below the bottom outlet opening 2 is disposed in known manner a casting mold (not shown) with a pouring funnel. The known casting machines in which such melting crucibles 1 are applied are, for example, vacuum casting machines for small parts. The material volume of the casting object can therein be in the range of approximately 5 $cm^3$ to 2000 $cm^3$. Since in particular the casting of precious metals involves expensive materials, for each casting process precisely that quantity of raw material is placed into the collecting volume 6 of the melting crucible 1 which is necessary for a subsequent casting process. As soon as the raw material in the collecting volume 6 is melted and brought to the correct casting temperature, the stopper 3 is opened and the liquid material flows through the bottom outlet opening 2 into the casting mold. It is herein essential that as high an outflow rate is attained as possible and that the liquid material fills completely the cross section of the cylindrical region 4 of the bottom outlet opening 2. Therewith maximum volume throughputs can be attained. But for this purpose it must be ensured that in the region of the bottom outlet opening 2 and in the annular throughflow channel between the front end of stopper 3 and the start of the bottom outlet opening 2 no turbulences occur and the liquid material flow does not become detached from the walls. Therewith is also ensured that the liquid material jet when exiting from the bottom outlet opening 2 until it enters the casting mold forms a full, quiescent and uniform jet and not one that is deflected or non-quiescent.

In order to achieve this, the bottom outlet opening 2 comprises a cylindrical region 4 and a transition region 7. The cylindrical region 4 has a length which is at least the twofold of the diameter of this cylindrical region 4. Between the cylindrical region 4 of the bottom outlet opening 2 and a bottom surface 5 of the collecting volume 6, a transition region 7 is implemented. This transition region 7 diverges from the cylindrical region 4 toward the collecting volume 6 and comprises a wall surface 8 curved inwardly or in the direction of the pouring axis 9. The curvature of this wall surface 8 is uniform and corresponds to a radius of at least 2 mm and maximally to a radius greater by the factor twelve than the radius of the bore in the cylindrical region 4 of the outlet opening 2. The curvature of the wall surface 8 changes uniformly and without steps, on the one hand, over into the wall of the cylindrical region 4 of the bottom outlet opening 2 and, on the other hand, into the bottom surface 5 of the collecting volume 6. The bottom surface 5 of the collecting volume 6 comprises, in addition, a slope directed toward the bottom outlet opening 2 and forms with an imaginary horizontal plane an angle 18 of at least 5°. This implementation of the bottom surface 5 and its transition into the bottom outlet opening 2 ensures that liquid material flowing in the direction of arrow 19 flows without detachment from the walls through the bottom outlet opening 2 and no turbulences are formed in the wall regions. As a counterpiece the stopper is formed with a conical tip 10 at the front end, which forms an angle of at least 50° and maximally 140°. Adjoining this conical tip 10 on stopper 3 upstream is a sealing region 11 which comprises an outer surface 13 curved outwardly. This outer surface 13 is curved at a radius 16 which also is at least 2 mm however maximally twelve times as large as the radius of the cylindrical region 4 of the bottom outlet opening 2. The curvature of the outer surface 13 of the sealing region 11 on stopper 3 is uniform and changes, on the one hand, without a step into the surface of the conical tip 10 and, on the other hand, into the approximately cylindrical surface 20 of stopper 3. This embodiment according to the invention also ensures on the side of the material flow directed toward the stopper 3 that the liquid material flow is in contact on the surfaces in the front region of stopper 3 and no turbulences occur in the casting jet. Since in this type of casting process the regulation of the quantity is not necessary, the stopper 3 is raised at the beginning of the casting process so far that the maximum flow rate of the casting jet is attained and the stopper 3 remains open until the desired quantity of material has flown into the casting mold. Normally the collecting volume 6 of the melting crucible 1 is therein completely emptied, but cases may occur in which for some reason the bottom outlet opening 2 must be closed prematurely.

The embodiment according to the invention of the outlet device on the melting crucible 1 shown permits in every case the secure closure of the bottom outlet opening 2 by lowering the stopper 3. The contact surfaces between the front end of stopper 3 and the transition region 7 of the bottom outlet opening 2 are linear due to the curved surfaces, and even at relatively low pressing forces of the stopper 3 already sufficiently large sealing forces result in order to close the bottom outlet opening 2 securely. In addition, the shape according to the invention of the bottom outlet opening 2 and of the front end of stopper 3 yields the advantage of a self-cleaning effect such that on the walls no deposits form and in particular no residues accumulate in the regions between the sealing line between the sealing region 11 on stopper 3 and the transition region 7 of the bottom outlet opening 2 and the exit from the bottom outlet opening 2. In this region the bottom outlet opening 2 is flushed out completely by the outflowing material flow. Residual particles adhering on the sealing region in the collecting volume 6 on the bottom surface 5 or on the outer jacket 17 are melted again during the succeeding melting process. Thereby an improvement of the quality and greater security for avoiding interruptions during the casting processes result. Nevertheless, the desired acceleration of the casting process is ensured and, compared to the known conventional outlet devices, the same quantity of material can be poured off in shorter time or greater quantities of material can be poured off in the same time. This leads to greater economy of the installation and also to an improvement of quality. Through the greater casting rate the solidification process in the casting mold becomes more uniform and the formation of different solidification regions is reduced whereby the quality of the cast object is improved.

I claim:

1. An outlet device for a melting crucible for a vacuum casting installation for small parts, the melting crucible having a bottom outlet opening in the form of a cylindrical bore and a stopper for closing the bottom outlet opening, the outlet device comprising:

a transition region formed in the bottom outlet opening between a cylindrical region and a bottom surface of the melting crucible, the transition region expanding toward a collecting volume of the melting crucible, and a curved wall surface in the transition region curving to a direction of a pouring axis of the melting crucible, the transition region forming a stepless connection surface between the bottom surface of the melting crucible and the cylindrical region; and wherein the stopper comprises a conical tip, a sealing region adjoining the conical tip, the sealing region having a convex outer surface.

2. An outlet device for a melting crucible according to claim 1, wherein the curved wall surface has a radius of curvature of at least 2 mm and the radius of curvature is maximally greater by a factor of twelve over the radius of a bore of the cylindrical portion of the outlet opening.

3. An outlet device for a melting crucible according to claim 1 wherein an angle formed by the conical tip is at least 50° and maximally 140°.

4. An outlet device for a melting crucible according to claim 1, wherein a radius of the convex outer surface of the sealing region is at least 2 mm and is maximally a radius which is greater than a bore radius of a bore of the cylindrical portion of the outlet opening by a factor of twelve.

5. An outlet device for a melting crucible according to claim 1, wherein a ratio of a length of the cylindrical portion of the outlet opening to a diameter of the outlet opening is at least 2:1.

6. An outlet device for a melting crucible according to claim 1, wherein the bottom surface of the collecting volume is inclined and rises from the outlet opening toward an outer jacket of the melting crucible, the bottom surface forming an angle of at least 5° relative to a horizontal plane.

* * * * *